United States Patent [19]

Martin

[11] Patent Number: 4,669,236

[45] Date of Patent: Jun. 2, 1987

[54] MEMORIAL HOLDERS FOR CREMATION ASHES

[76] Inventor: Peter D. Martin, 96 Unley Road, Unley, South Australia, Australia, 5061

[21] Appl. No.: 827,721

[22] Filed: Feb. 10, 1986

[30] Foreign Application Priority Data

Feb. 14, 1985 [AU] Australia ..... PG9293

[51] Int. Cl.[4] ..... E04H 13/00

[52] U.S. Cl. ..... 52/100; 52/137; 52/139; 52/741

[58] Field of Search ..... 52/136, 137, 139, 100, 52/741; 144/360, 366, 365; 73/864.44

[56] References Cited

U.S. PATENT DOCUMENTS

| | | | |
|---|---|---|---|
| 617,161 | 1/1899 | Hunter | 52/133 |
| 715,631 | 12/1902 | Ayres | 144/365 |
| 1,331,172 | 2/1920 | Viquesney | 52/136 |
| 4,023,316 | 5/1977 | Martin | 52/139 |

*Primary Examiner*—John E. Murtagh

*Attorney, Agent, or Firm*—Cushman, Darby & Cushman

[57] ABSTRACT

A memorial cremation ashes holder providing for niches in a stone slab for holding of ashes, the slab having cylindrical apertures drilled with an open end opening through the display face of the stone slab but which is substantially hidden by using a cylindrical core in the drilled aperture until use of the aperture is necessary.

10 Claims, 4 Drawing Figures

MEMORIAL HOLDERS FOR CREMATION ASHES

Figure 1:
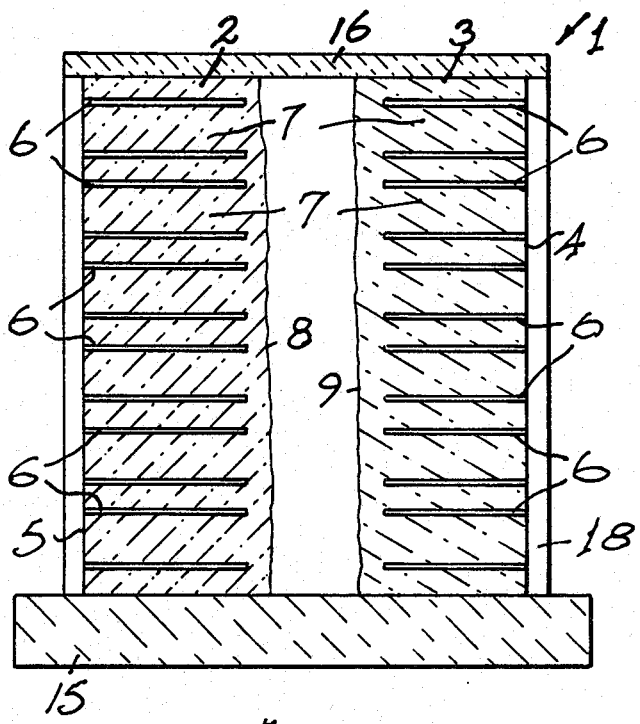

This invention relates to memorial holders intended for holding a persons' ashes in identifiable separate apertures.

Tne problems associated with providing such a facility are very substantial especially in view of the highly emotive difficulties of relatives and friends of those whose ashes are interred.

I have hitherto proposed an arrangement in which a plurality of apertures are cut from a rear face of slab of stone and as access to each of the apertures is required, an impact from a front of the slab achieves a break down of the remaining stone material enabling easy removal of a core piece and then subsequent availability of the appropriate size aperture for location of the ashes and a memorial plaque.

One of the significant difficulties hitherto has been that if one provides an appropriate wall having a plurality of ashes located therein open to a front face, it has been found the open character of such apertures is not highly regarded by some attending the location.

I have found, however, according to this invention that there is an advantage in proposing a further technique which aviods disadvantages of the apparent open niches and it also achieves advantage in terms of cost.

This invention can accordingly be said to reside in a memorial cremation ashes holder providing for a plurality of niches for the holding of the ashes therein comprising a stone slab having a front decorative display face and at each of a plurality of niche locations there being a cylindrical shaped aperture only one end of which is open and which end coincides with the display face, there being at least one of the niche locations a cylindrical shaped aperture with a solid cylindrical core located therein being positioned coaxially with respect to the aperture with an outermost end coincident with the face of the front decorative display face.

Preferably the slab is comprised of marble.

Such material has a weak tensile strength as compared with its compresive strength and further by reason of its inherent brittleness, a solid cylindrical core can be fractured and separated from the remaining portion of the slab at its root by sufficient pressure being applied against one side adjacent the decorative face.

It is understood that the depth of the aperture is such as to allow adequate remaining thickness in the slab to resist effectively a breaking through the slab in such circumstances.

In preference, the open end of at least one of the niche apertures is constituted by an annular slot.

In preference, each of the niche locations are defined by a cylindrical shape which has its axis perpendicular to a plane defined by the decorative face of the slab.

In a further form of this invention it can be said to reside in a method of providing for the retention of cremation ashes which method comprises the steps of drilling an aperture of cylindrical shape through a decorative face of a slab, leaving a core within the aperture so as leave an annular slot coincident with the decorative face, the aperture not fully passing through the slab, and upon any one of the locations being required, effecting a pressure against one side of the core, engaging the core once fractured and extracting this from the aperture providing thereby the required niche.

Figure 2:
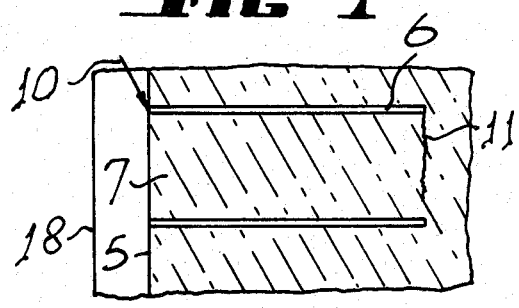
Figure 3:
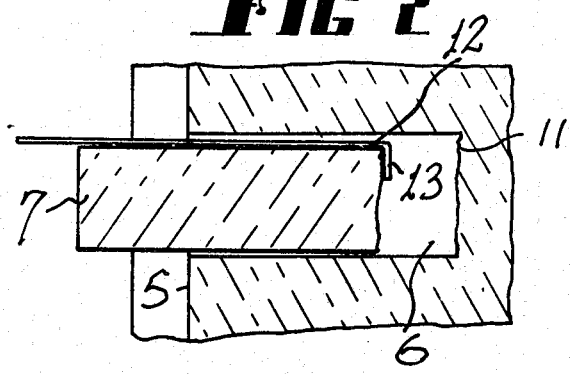
Figure 4:
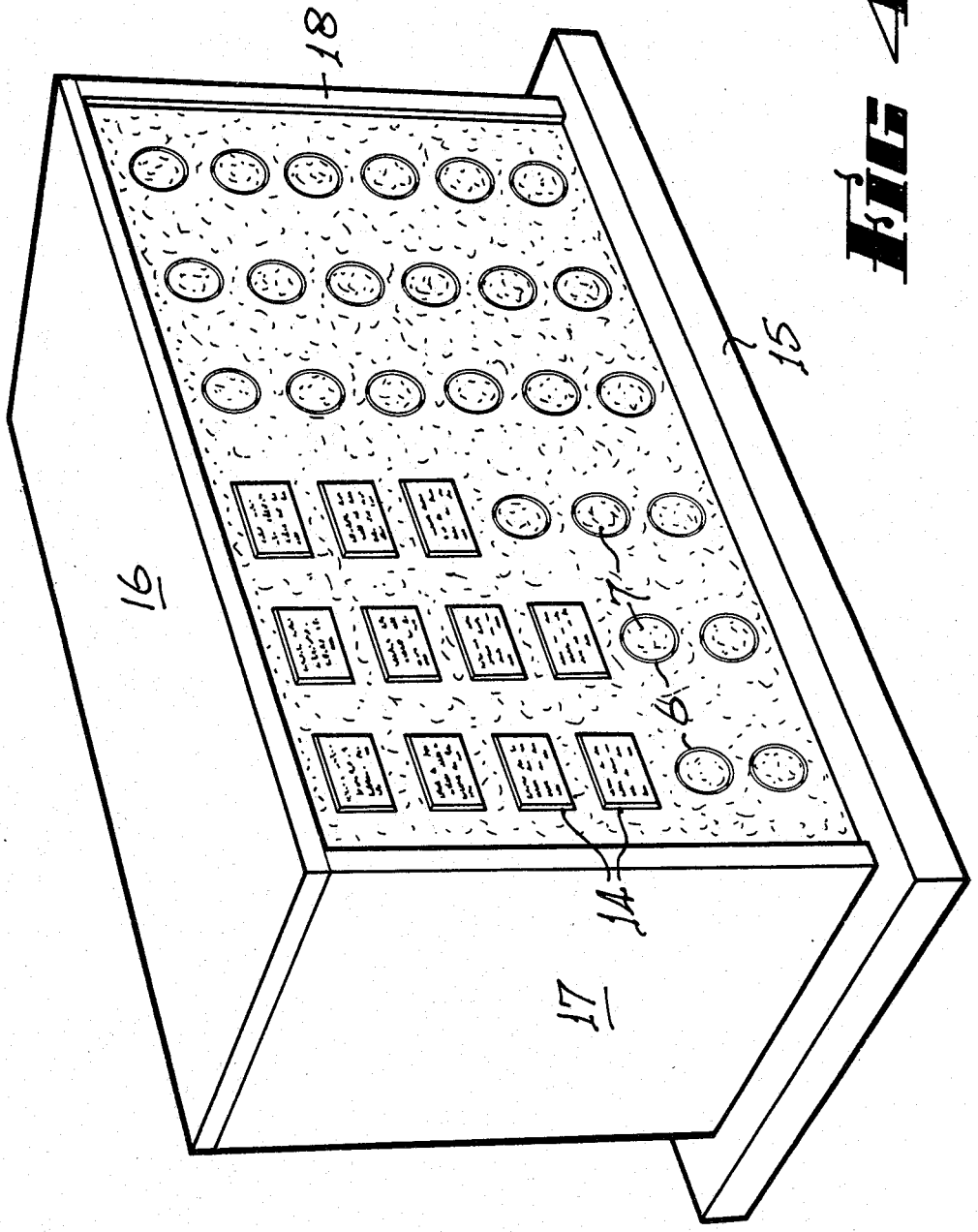

The invention will be better understood when described in respect to a preferred embodiment which will now be described with the assistance of drawings in which FIG. 1 is a side elevation in cross section of a memorial cremation ashes holder, FIG. 2 is a portion of FIG. 1 in some enlarged detail showing a direction of impact effective for insuring a fracturing of a cylindrical core within the cylindrical aperture, FIG. 3 illustrates the way the cylindrical core once fractured can be removed and FIG. 4 is a perspective view of the whole of a memorial cremation ashes holder all according to the same embodiment. Referring in detail to the drawings, there is provided a memorial cremation ashes holder 1 which includes two stone slabs 2 and 3 each of which slab is comprised of marble and has an external decorative display face at 4 and 5.

The decorative finish on the planar face 4 and 5 is achieved by repeated impacts of a hammer like object which provides a slightly roughened but nonetheless attractive texture which has the effect both of providing a decorative finish and to some extent because of causing a shadow effect disguising apertures.

Drilled at regularly spaced intervals and in rows from the respective display faces 4 and 5 are a plurality of apertures 6 each of which are of a cylindrical shape leaving thereby a cylindrical core 7.

Accordingly the open end of each of the cylindrical shaped apertures 6 has an open end which coincides with the display face either 4 or 5 and each of the cylindrical cores are located co-axially with respect to the aperture 6 and having an outermost end coincident with the face of the decorative face either 4 or 5.

The depth of the cylindrical aperture 6 is restricted so that it will not extend fully through the stone slab 2 or 3 and further will leave sufficient thickness from the side opposite that is 8 or 9 of the decorative face 5 or 4 so that when a fracturing away of the cylindrical core 7 is required this can be achieved without a break through to the said other side that is either 8 or 9.

There is in this arrangement therefore a gap between the cylindrical aperture and the cylindrical core and as an illustration the size that has been found appropriate for drilling purposes while at the same time not appearing to be excessively obvious with an appropriate hammer finish, the size of three millimeters from face to face has been found appropriate.

This is related to the total diameter of the cylindrical aperture at twelve centimeters and in one case, the depth of the aperture is twenty centimeters.

A further five centimeters behind the aperture will provide generally sufficient thickness to resist fracturing through the slab.

Obviously these dimensions can be varied by experimentation in respect of any particular stone type which does vary from type to type and from location to location.

With the holder 1 as shown when a niche is required, because the stone material is essentially weak in tension although strong in compression it is found that by use of either an impact against an edge in the direction and as is shown in FIG. 2 at 10 will have the effect of fracturing the cylindrical core at 7 at location 11 with the result that the cylindrical core will be separate and then by use of a removal tool as shown at 12 which has a downwardly extending tongue 13, this can be located through the slot and with some manipulation it is found the tongue can be usually turned into a gap then existing between the fractured surfaces and the core 7 removed as shown in FIG. 3.

Subsequent to removal of the solid core 7, the appropriate ashes within an urn can be located in the cylindrical aperture and an appropriate memorial plaque 14 can be located to close the aperture 6.

The respective slabs 2 and 3 are located for total presentation purposes on a foundation stone 15 and are encased between a top stone 16 and two side stones 17 and 18.

What has been described accordingly provides an effective and economic means for providing a memorial cremation ashes holder.

I claim:

1. A memorial cremation ashes holder comprising a stone slab having an upright display face, said display face having at least one cylindrical, generally horizontal niche therein, the niche having an inner end closed by the material of the slab and having an outer end coinciding with said display face; a memorial plaque having a face provided with indicia, said plaque closing the outer end of said niche with said face of said plaque facing outwardly with respect to said display face of said slab; said slab further having at least one generally horizontal annular aperture extending inwardly from said display face and terminating within the material of said slab whereby a core of the material of said slab exists concentrically within each annular aperture, the annular aperture and the core thus providing a niche location which forms a cylindrical niche upon removal of the core from the annular aperture.

2. A holder as in claim 1 wherein said slab is comprised of marble.

3. A holder as in claim 1 wherein said display face has a hammer finish.

4. A holder as in claim 1 wherein said apertures are of such a depth that there is left a thickness of slab between the closed end of each aperture and the face of the slab oppositely positioned to the display face of the slab such that said thickness will ensure that upon a breaking of the cylindrical core by pressure against a side adjacent the display face and just sufficient to separate by fracture the cylindrical core the slab will not break through to the said opposite face.

5. A memorial cremation ashes installation comprising:

a stone slab having an upright display face and an opposite face, the display face being accessible and viewable by an external observer and the opposite face being inaccessible and shielded from view by other structure forming part of the installation, said slab having at least one generally annular aperture extending from said display face toward said opposite face and terminating in a closed end within the material of said slab whereby a cylindrical within the annular aperture, the annular aperture and the core thus providing a niche location which forms a cylindrical niche upon removal of the core from the annular aperture.

6. An installation as in claim 5 wherein said slab is comprised of marble.

7. An installation as in claim 5 wherein said display face has a hammer finish.

8. An installation as in claim 5 wherein each aperture is of such a depth that there is left a thickness of slab material between the closed end of each aperture and the inaccessible face of the slab such that said thickness will ensure that upon breaking of the cylindrical core by pressure against a side adjacent said display face and just sufficient to separate by fracture the cylindrical core the slab will not break through to said inaccessible face.

9. A method of providing for the retention of cremation ashes within niches in a slab having a display face and an opposite face which method comprises the steps of drilling an aperture of annular shape through the display face of the slab leaving a core within the aperture so as to leave an annular slot coincident with the decorative face, the aperture terminating within the slab, and upon any one of the locations being required for forming a niche, inserting into one side of the annular slot at a location on the display face a wedge and causing a sufficient deflection to separate the core from the slab, engaging the core and extracting the core from the display face and the aperture providing thereby the required niche.

10. A method of providing a plurality of niches in a slab for the retention of cremation ashes, said slab having an outer display face and an opposite face, the method comprising: forming a plurality of parallel, spaced-apart annular apertures in the display face of the slab so as to leave a core of slab material within each aperture, the annular apertures terminating in closed ends within the slab; subsequently forming a niche at the location of a selected annular aperture by applying a force radially to the end portion of the respective core at a location near the display face sufficient to fracture the respective core at the location of the closed end of the selected annular aperture; and extracting the core outwardly through the display face thereby leaving a cylindrical niche having an open end at the display face and a closed end within the slab.

* * * * *